US005470266A

United States Patent [19]

Stanley et al.

[11] Patent Number: 5,470,266

[45] Date of Patent: Nov. 28, 1995

[54] LOW TEMPERATURE PROCESS AND APPARATUS FOR CLEANING PHOTO-CATHODES

[75] Inventors: Donald H. Stanley, Bedford; Robert Peckman, Roanoke; Weston K. Peregoy, Jr., Fredericksburg, all of Va.

[73] Assignee: ITT Corporation, New York, N.Y.

[21] Appl. No.: 271,028

[22] Filed: Jul. 6, 1994

[51] Int. Cl.[6] ..... H01J 9/38; H01J 9/12

[52] U.S. Cl. ..... 445/59; 445/73

[58] Field of Search ..... 445/59, 53, 57, 445/73

[56] References Cited

U.S. PATENT DOCUMENTS

| | | | |
|---|---|---|---|
| 1,927,812 | 9/1933 | Thomson | 445/57 |
| 4,153,317 | 5/1979 | Ljung et al. | 445/59 |
| 4,799,911 | 1/1989 | Relder | 445/14 |
| 4,954,717 | 9/1990 | Sakamoto et al. | 250/492.3 |
| 5,029,963 | 7/1991 | Naselli et al. | 350/96.18 |
| 5,244,428 | 9/1993 | Welsch et al. | 445/59 |
| 5,314,363 | 5/1994 | Murray | 445/14 |

OTHER PUBLICATIONS

Sherk et al., "Cleaning and Enhancing the Characteristics of a Gas Discharge Panel," *IBM Tech. Discl. Bull.*, 20 [12] (May 1978): 5209.

*Primary Examiner*—P. Austin Bradley
*Assistant Examiner*—Jeffrey T. Knapp
*Attorney, Agent, or Firm*—Arthur L. Plevy; Patrick M. Hogan

[57] ABSTRACT

A low temperature apparatus and process exists for cleaning photo-cathodes used in image intensifier tubes. The process comprises the steps of applying atomic or molecular particles of a plasma to a photo-cathode for the purpose of removing contaminants, such as oxides, from the photo-cathode surface; and applying heat or ultra-violet radiation to the photo-cathode to remove remaining impurities. The apparatus comprises means for subjecting a photo-cathode to the atomic and molecular particle products of a plasma, and preferably, means for applying heat or ultra-violet radiation to the photo-cathode at a low temperature to remove any remaining impurities from the photo-cathode.

28 Claims, 4 Drawing Sheets

LOW TEMPERATURE PROCESS AND APPARATUS FOR CLEANING PHOTO-CATHODES

FIELD OF THE INVENTION

The present invention relates in general to the fabrication of image intensifier tubes and more particularly to a low temperature process and apparatus for cleaning photo-cathodes of Third Generation (GEN. III) image intensifier tubes and the like.

BACKGROUND OF THE INVENTION

Image intensifier tubes are well known devices for enhancing night-time vision. The image intensifier multiplies the amount of incident light received from an object and produces an intensified image which can be more easily viewed. Thus, at night-time or under otherwise low light conditions, the ability to view objects is enhanced. Accordingly, devices that employ image intensifier tubes are used in a wide variety of industrial and military applications. The U.S. Military, for example, uses image intensifiers during night-time operations wherein night radiation is reflected from targets that would not otherwise be visible, and the reflected energy is amplified by the image intensifier. As a result, the target becomes visible without the necessity of additional light. Other examples of the use of image intensifiers include providing night vision to sufferers of retinitis pigmentosa (night blindness); enhancing night vision of aviators; and improved photography of astronomical objects.

Image intensifiers are well known in the industry by names for particular designs based on the generic generation from which those designs evolved. Accordingly, image intensifier tubes are typically identified by their generation number, such as the Generation 0 tube to the contemporary Generation III (GEN. III) tube. Modem GEN. III image intensifier tubes typically employ three major components—a GaAs photo-cathode, a phosphor screen (anode) and a micro-channel-plate electron amplifier. The photo-cathode converts incident light energy patterns into electron patterns which are multiplied by the electron amplifier. The phosphor screen then converts the amplified electron pattern back into a light pattern. All three components are disposed within an evacuated housing which permit electrons to flow from the photo-cathode across the electron amplifier to the phosphor screen. Examples of such devices are disclosed in U.S. Pat. No. 5,029,963 entitled REPLACEMENT DEVICE FOR A DRIVER'S VIEWER, issued to Naselli et al. and assigned to ITT Corporation, the assignee herein. (This reference discusses both GEN II and GEN III image intensifier tubes).

During the fabrication of a GEN. III image intensifier tube, the photo-cathode must be cleaned and a layer of negative electron affinity material, such as cesium oxide, applied to it, prior to assembly of the photo-cathode to the vacuum tube housing. The GEN. III photo-cathode has a GaAs surface having contaminants, such as metal oxide deposits, disposed thereon which must be removed during the cleaning process. Other compound semiconductor photo-cathodes have similar contaminants which require removal.

Conventionally, the photo-cathode is cleaned using a high temperature cleaning process. The high temperature is sufficient to vaporize the surface contaminants thereby exposing a clean surface. One problem with this high temperature cleaning is that the temperature of the photo-cathode must be maintained within a relatively narrow window during the cleaning process. A typical window would be, for example, 610°–630° C. Due to the limitations of temperature controlling methods, it is difficult to achieve cleaning operation within this window with 100% accuracy. Temperatures below the window yield insufficiently clean cathodes, resulting in non-uniform photo-response defects. Temperatures above the window produce excess thermal strain which results in crystal slip defects.

Another problem is that the high temperature causes the dopants, such as zinc, to become depleted from the surface resulting in reduced photo-response. The high temperature also precludes the use of many face-plate glasses which are less well matched to GaAs, such as those used in fiber-optics, which cause enough thermal stress to result in crystal slip defects below the temperature required for cleaning. In addition, the high temperature precludes the use of improved cathode structures, such as thinner window layers, which cannot tolerate the thermal stress resulting from conventional process temperatures.

Moreover, to maintain the temperature within the high temperature window necessitates the use of sophisticated temperature monitoring and control equipment. Typically, the photo-cathode temperature is monitored during the heat cleaning step by employing an infrared camera which is directed towards the photo-cathode being cleaned. The radiant energy of the photo-cathode is monitored and converted to temperature data. This data is relayed to temperature control equipment which controls the heat source supplying the high temperature heat. Thus, it would be desirable to eliminate the need for complex temperature sensing and control equipment by using a low temperature process.

FIG. 1 illustrates a prior art high temperature photo-cathode cleaning apparatus 10. Photo-cathodes 15 are first loaded onto a stand 12 and transferred to receptacles 14 by means of an automatic transfer mechanism 18. Photo-cathodes 15 are then transferred to a heat cleaning stand 17 within cleaning chamber 11 by another automatic transfer mechanism 16. A high temperature heating element 13 in proximity to the photo-cathode being cleaned is coupled to control equipment (not shown) to provide the precise high temperature required. An infrared camera 19 monitors the photo-cathode temperature. When the precise temperature window is reached, the control equipment, which is also coupled to the camera 19, controls the heating element 13 to maintain temperature within the critical window. After the heat cleaning, the photo-cathode is transferred to process well 60 where a negative electron affinity layer, such as cesium oxide, is applied.

A similar apparatus to that of FIG. 1 is disclosed as a portion of an overall automated system in a co-pending U.S. Patent application Ser. No. 08/073,746 entitled AUTOMATED SYSTEM AND METHOD FOR ASSEMBLING IMAGE INTENSIFIER TUBES, filed on Jun. 8, 1993 for T. Murray, and assigned to ITT, the assignee herein.

A serious problem with non-uniform photo-response and crystal slip defects is that they are not detectable until the completed image intensifier tube can be powered on. When the tube fails at this point as a result of the defect, considerable costs have incurred.

It is therefore an object of the present invention to provide a low temperature cleaning process for photo-cathodes used in image intensifier tubes that overcome the problems of the prior art.

It is an additional object of the present invention to provide a low temperature cleaning process that does not require precise control of the cleaning process temperature.

It is a further object of the present invention to provide a low temperature conditioning process which removes the photo-cathode contaminants more reliably, thus avoiding non-uniform photo-response.

It is another object of the present invention to provide a low temperature conditioning which results in less thermal stress, and therefore avoiding crystal slip defects.

It is an additional object of the present invention to provide a low temperature conditioning which results in less temperature induced diffusion of dopants, and therefore avoiding the resulting degradation of photo-response.

It is a further object of the present invention to provide a low temperature conditioning process which will tolerate the use of face-plate materials which are less well matched to the thermal expansion properties of the active cathode material than the conventional face-plate glasses.

It is another object of the present invention to provide a low temperature conditioning process which will produce less thermal stress and accommodate cathode structures which are less tolerant of stress, such as thinner-window-layer cathode structures.

It is a further object of the present invention to provide such a low temperature photo-cathode cleaning process that utilizes the action of atomic and molecular particles, such as those produced in a plasma.

It is an additional object of the present invention to combine the action of the atomic and molecular particles with a low temperature degas to clean Third Generation and similar photo-cathodes.

SUMMARY OF THE INVENTION

The present invention is a low temperature process and apparatus for cleaning photo-cathodes used in image intensifier tubes and other light-sensing devices. The process comprises applying plasma-induced particles to the photo-cathode for the purpose of removing contaminants such as oxides from the photo-cathode surface, preferably followed by a degas step. The degas step applies heat at a low, noncritical temperature, or ultra-violet radiation to the photo-cathode to remove remaining impurities such as gas and moisture from the photo-cathode.

The apparatus according to the invention comprises a chamber wherein the photo-cathodes are disposed -for cleaning; means for evacuating the chamber prior to cleaning the photo-cathode; means for applying the atomic and molecular products of a plasma to the photo-cathode to remove contaminants, such as oxides from the photo-cathode surface; and means for applying heat or ultra-violet radiation to the photo-cathode at a low temperature to remove remaining impurities in the form of gas and moisture from the photo-cathode.

Optionally, the apparatus is equipped with a plurality of receptacles within the chamber for retaining a plurality of photo-cathodes to be cleaned and means for automatically transferring photo-cathodes to and from the receptacles and a mounting stand which mounts one photo-cathode at a time for plasma conditioning. Automatic transferring means may also be employed for the low temperature heating operation (out-gassing), such that a plurality of photo-cathodes can be cleaned in one operation.

DETAILED DESCRIPTION OF THE INVENTION

Figure 2:
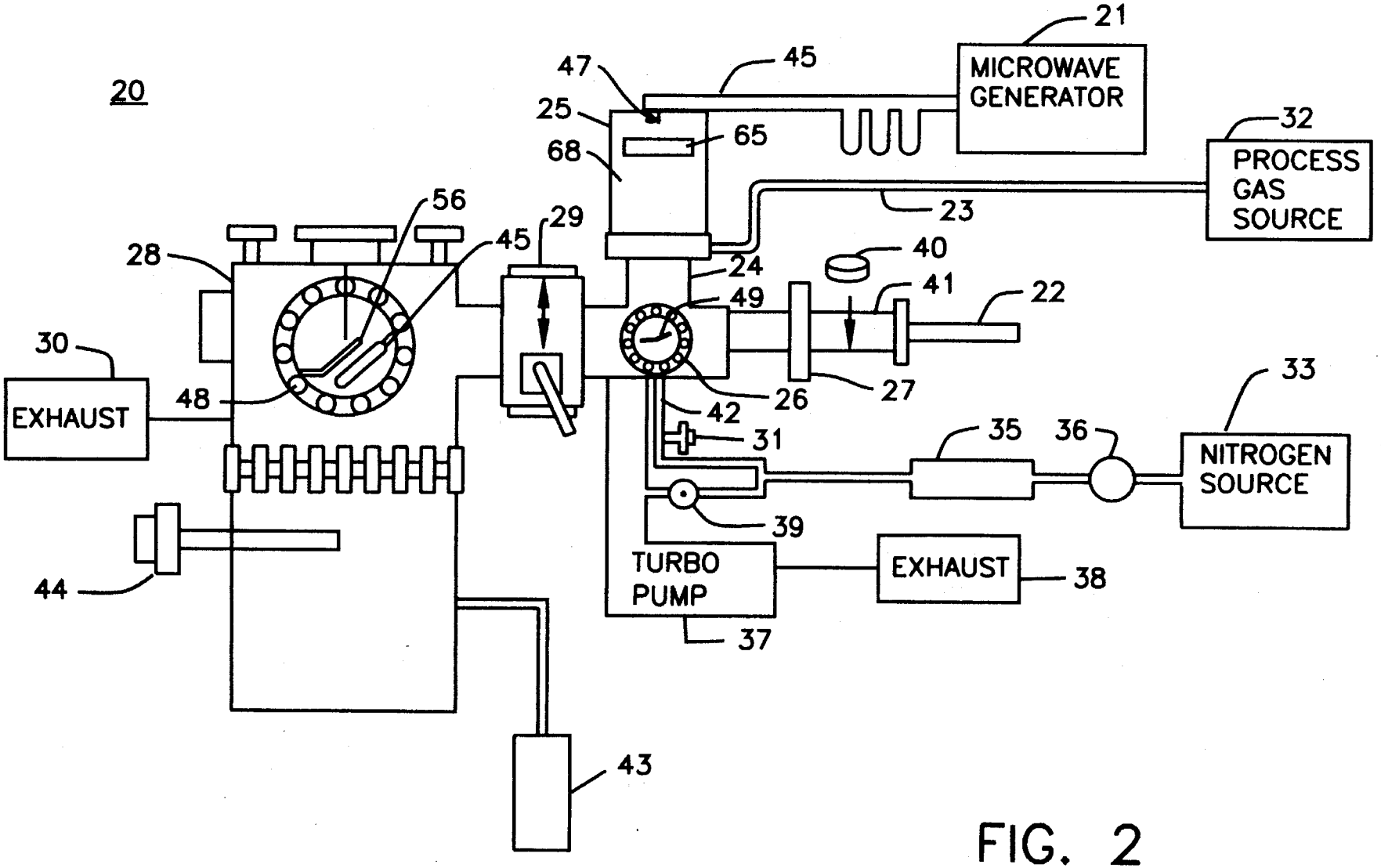
FIG. 2 shows the preferred embodiment of a low temperature photo-cathode cleaning apparatus according to the present invention.

A process for cleaning photo-cathodes utilizing atomic and molecular particles to remove impurities from the cathode surface. FIG. 2 shows a preferred embodiment of the implementation of a low temperature photo-cathode cleaning apparatus 20 and process according to the present invention. Although the cleaning process is preferably a two step process, the first "plasma" step could be used by itself without the second "de-gassing" step as an alternative approach to cleaning the photo-cathodes. As will be described, the first step involves removing contaminants, such as oxides, from the photo-cathode metallic surface by means of exposing it to the atomic and molecular products of a plasma in a cleaning chamber 24. This step may be readily performed at room ambient temperature. The second step involves removing residual impurities from the photo-cathode by a degas (out-gassing) process. The degassing is performed under a relatively low temperature below 500° C., and may be done in a separate degas chamber 28 as shown in FIG. 2.

Figure 1:
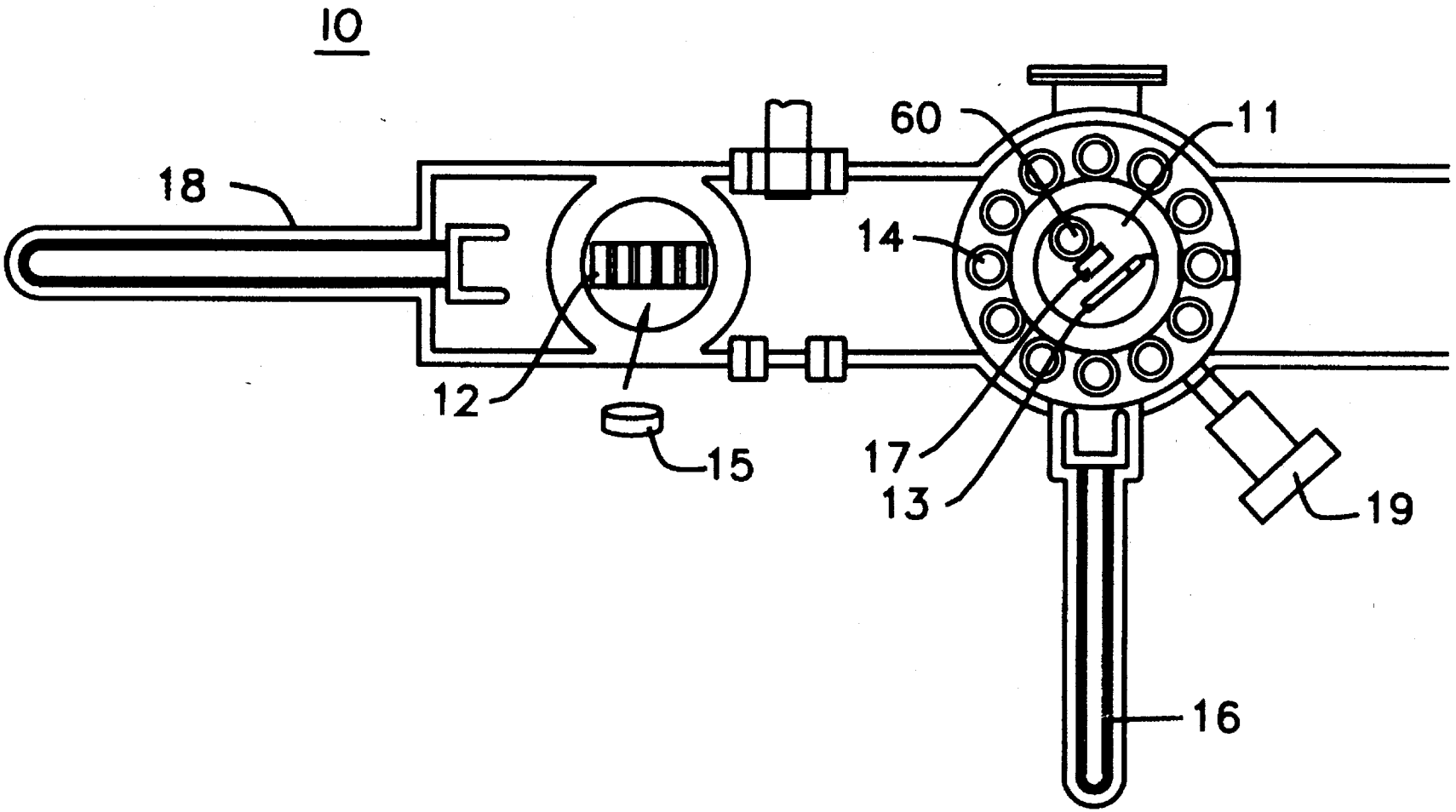
FIG. 1 (PRIOR ART)
FIG. 1 is an illustration of a prior art high temperature photo-cathode cleaning apparatus.

The plasma step of the cleaning process is now described. Photo-cathodes are loaded either manually or by automatic means into the photo-cathode cleaning chamber 24 for plasma cleaning. FIG. 2 illustrates an automatic loading system embodiment. Photo-cathodes 40 are introduced onto a stand (not shown) within loading port 41. An automatic transfer mechanism 22 which is similar to the transfer mechanism 18 of FIG. 1 is employed to transfer the photo-cathodes 40 to receptacles 26 within chamber 24 where they are retained for cleaning. The chamber 24 can readily be designed to accommodate one or two photo-cathodes at a time for the cleaning process. Preferably, it is equipped to house upwards of ten photo-cathodes for automatic sequential cleaning in one process step, in order to expedite production and lower manufacturing costs. This would require an automatic transfer mechanism (not shown) similar to that of mechanism 15 of FIG. 1 to transfer the photo-cathodes one at a time to and from the receptacles 26 to a stand 49 where atomic and molecular particle conditioning is to occur. An example of a suitable automated loading system along with associated transfer mechanisms can be found in co-pending U.S. Patent application Ser. No. 08/073,746 entitled AUTOMATED SYSTEM AND METHOD FOR ASSEMBLING IMAGE INTENSIFIER TUBES, filed on Jun. 8, 1993 for T. Murray and assigned to the assignee herein.

Plasma conditioning of the photo-cathode is accomplished by subjecting the photo-cathode to the atomic and molecular products of a plasma. A plasma is an ionized gas in which electron and ion densities are substantially equal. The activity in the plasma results in the formation of other atomic and molecular particles, such as free radicals. The plasma is preferably formed by means of an Electron Cyclotron Resonance (ECR) plasma source and microwave energy to convert a process gas into a plasma.

An ECR plasma source 68 is attached to a port of the cleaning chamber 24. The plasma source consists of a focusing magnet 55 with a quartz bell-jar (not shown) and a canister 25. The focusing magnet serves to confine a process gas within a confined area where the process gas can be irradiated with microwave energy to ionize the gas and create the plasma. The ECR plasma source 68 including the magnet 55, bell-jar and canister 25 may be one that is well known and commercially available such as a plasma source manufactured by the ASTEX Corporation located in Massachusetts. A microwave generator 21 is coupled to the plasma source 68 via a transmission line 45 which may be waveguide, and an antenna 47 that directs the microwave energy through the quartz bell-jar. The generator 21 generates continuous wave (cw) microwave power of typically 40–600 watts cw, at a frequency in the range of about 2–4 GHz.

Prior to plasma conditioning, the chamber 24 is first evacuated by means of a turbo pump 37 which is coupled to an exhaust system 38. Before the evacuation, gate valves 27 and 29 are closed to seal the chamber 24. Process gas from process gas source 32, which is preferably about 90% Argon and 10% Hydrogen, is then introduced into the chamber 24 and the quartz bell-jar within canister 25 via a coupling line 23. During plasma cleaning of photo-cathodes, the process gas pressure is controlled to maintain pressure in the millitorr range within chamber 24. When the microwave generator 21 delivers microwave energy to the process gas within the area confined by focussing magnet 25, the gas is ionized to create a plasma.

As the plasma is created, its atomic and molecular products are immediately applied to a photo-cathode mounted on holding stand 49 to remove contaminants, such as oxides from the surfaces of the photo-cathode. During plasma conditioning, turbo pump 37 continually pumps the plasma products out of the canister 25 and cleaning chamber 24 and directs them to the exhaust system 38. In this manner, the plasma products continually flow past the photo-cathode as they chemically react with the contaminants thereon to thereby expose a clean photo-cathode surface. The process may leave residual contamination on the photo-cathode surfaces which is eliminated during the subsequent degassing step.

Figure 3:
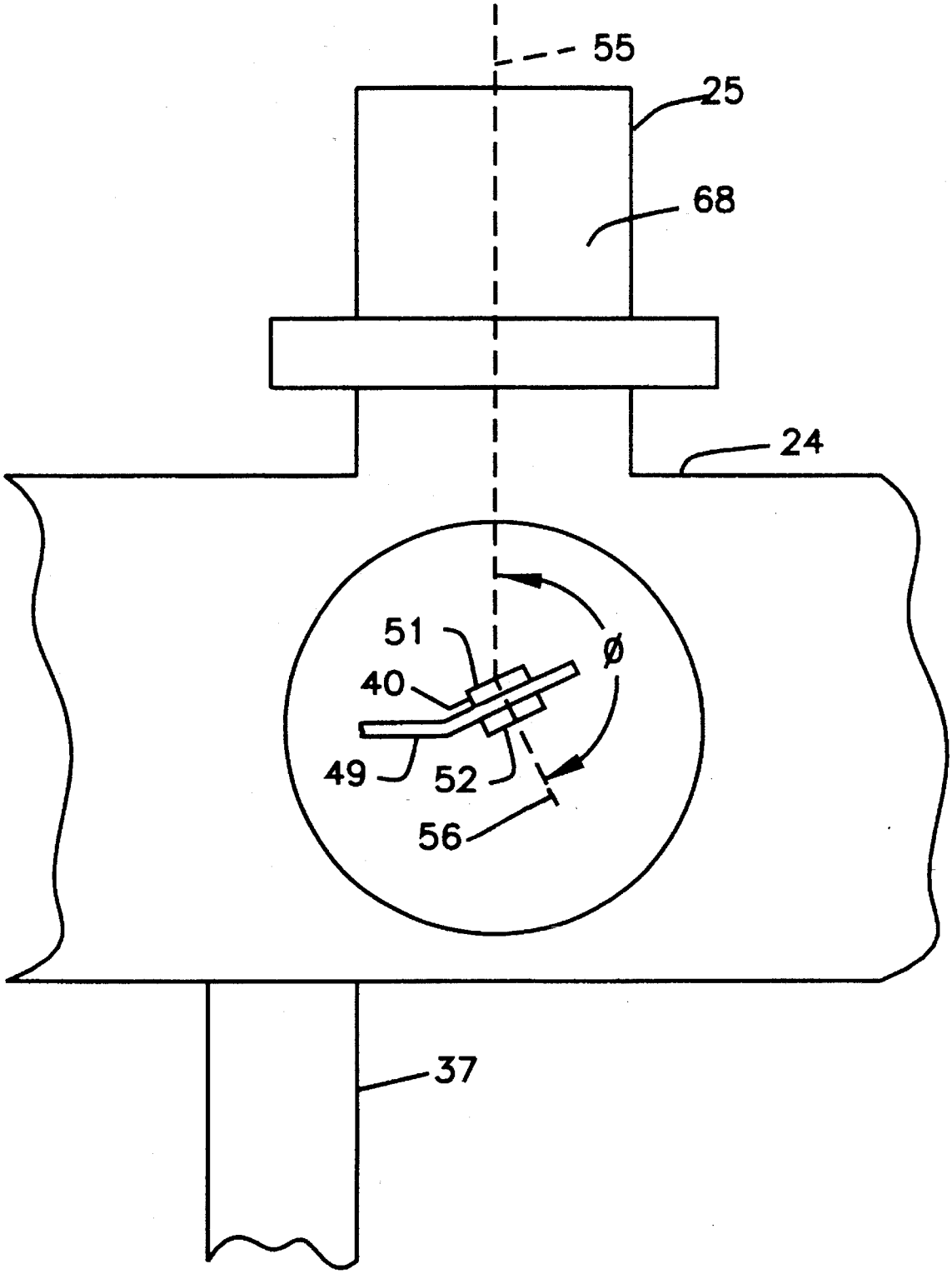
FIG. 3 is an illustration of a mounting orientation of a photo-cathode to be cleaned within the apparatus of FIG. 2.

Proper mounting and orientation of the photo-cathodes during the plasma process is important to the success of the operation. Plasma conditioning may result in ion etching which may cause low level damage to the photo-cathode if the photo-cathode orientation with respect to the plasma source is not optimized. Shown in FIG. 3 is a photo-cathode 40 mounted on a holding stand 49 within the cleaning chamber 24 of FIG. 2. Photo-cathode 40 is disc-shaped with a metallic surface 52 such as GaAs and a glass surface 51 on opposite ends. The semiconductor surface 52 bears the contaminants which are to be removed by the plasma conditioning. In Generation III photo-cathodes, for which the plasma conditioning process is well suited, this surface is GaAs. Other photo-cathodes may employ different III/V-compound active layer materials, such as InGaAs or GaAsP. It should be understood that the plasma conditioning and degas process (to be described) according to the invention may be successfully implemented to clean both GEN. III and these other similar photo-cathodes. However, the mounting orientation for these photo-cathodes to minimize damage during plasma conditioning, may differ from that of the GEN. III photo-cathodes depending upon the physical characteristics of the photo-cathodes.

As shown in FIG. 3, the plasma source 68 is attached to a port of chamber 24 such that the plasma source 68 is above the photo-cathode 40 to be cleaned. With the turbo pump 37 beneath chamber 24, the plasma products flow from the plasma source 68 past the photo-cathode 40 to the turbo pump 37. In this configuration, the photo-cathode 40 should be mounted such that the metallic surface 52 does not face directly towards the plasma source 68 but is instead rotated between 90° and 180° away from it. In this manner, a more manageable plasma conditioning process is provided without noticeable damage to the photo-cathode 40. As an illustration, FIG. 3 shows the GaAs surface 52 facing at an angle $\phi \approx 120°$ away from the plasma source 68 where $\phi$ is the angle between planes 55 and 56, where plane 55 is drawn on an axis to canister 25, and plane 56 is perpendicular to GaAs surface 52.

Figure 4:
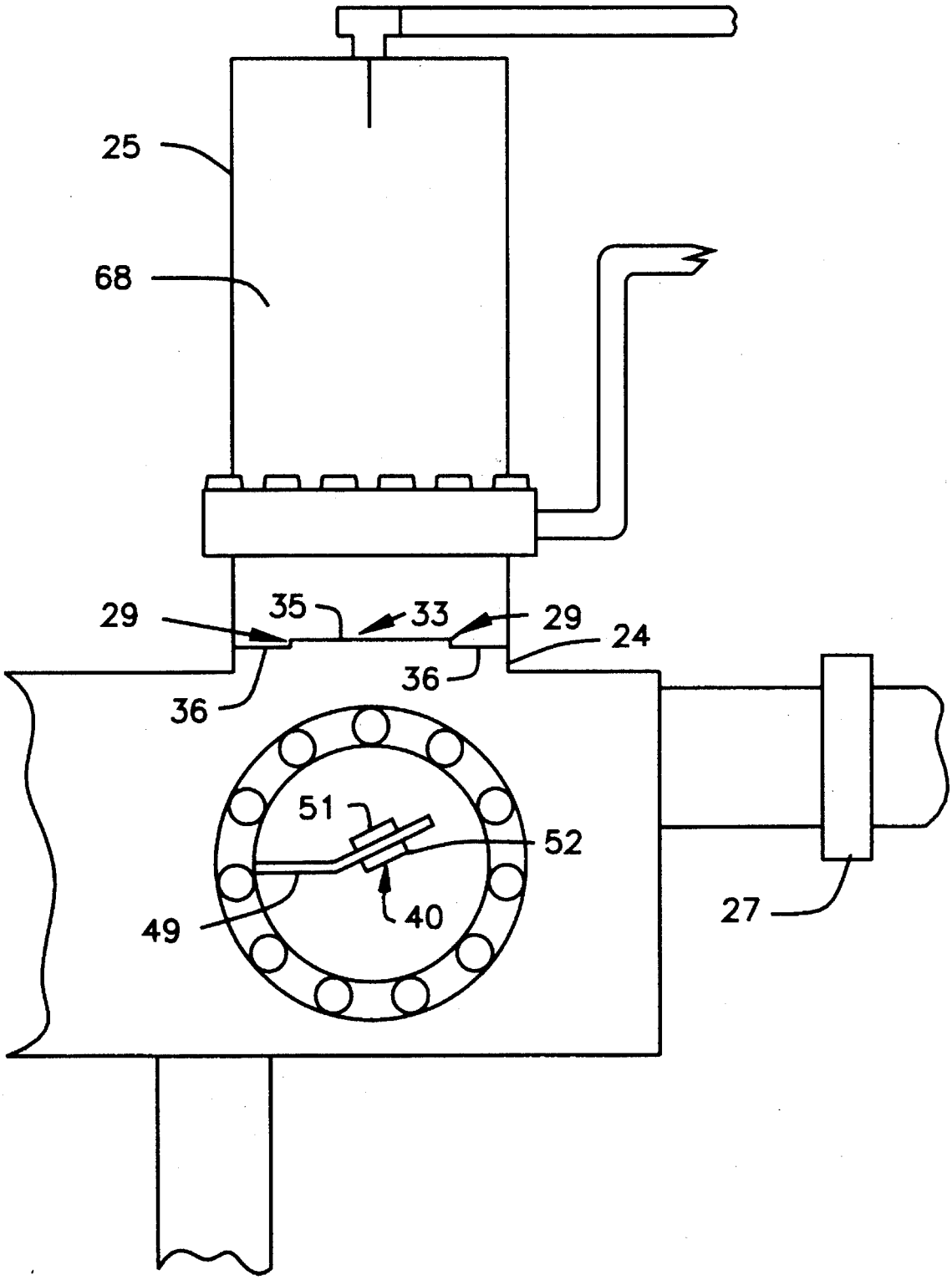
FIG. 4 shows an alternate configuration for minimizing photo-cathode damage during the plasma conditioning process.

Another configuration for minimizing damage to photo-cathodes 40 during the plasma conditioning process is shown in FIG. 4. A quartz baffle 33 is employed within cleaning chamber 24 between the photo-cathode 40 to be cleaned and the plasma source 68. The baffle 33 consists of two sections–an inner ring 35 and an outer ring 36. Between the two rings 35 and 36 are small gaps 29 in which the atomic and molecular particles pass through during plasma conditioning of the photo-cathode 40. Charged particles are discharged on the baffle and thus do not pass through gaps 29, thereby preventing undesirable ion etching of the photo-cathode 40. In the FIG. 4 configuration, the orientation of the photo-cathode is less critical since the baffle serves to protect the photo-cathode from this undesirable ion etching. As a result, it is not necessary for the GaAs metallic surface 52 of the photo-cathode 40 to be positioned away from the plasma source 68 as is the case in the FIG. 3 configuration.

In any event, as photo-cathode damage is often not detected until the completed image intensifier tube is fired up, and costly losses have occurred, the importance of minimizing damage during plasma conditioning step cannot be overemphasized. The amount of time allocated to plasma conditioning, along with the turbo pump flow rate, are also factors which impact photo-cathode damage control. A plasma conditioning time of approximately one minute with a sufficient turbo pump flow rate may be enough to remove the contaminants with negligible photo-cathode damage.

Referring again to FIG. 2, the chamber 24 preferably houses ten or more photo-cathodes in receptacles 26 for sequential automatic cleaning, as previously mentioned. The receptacles 26 should have sufficient sealing means such that the atomic and molecular particles cannot enter the receptacles 26, which could otherwise cause over-exposure damage. After the plasma conditioning step, the microwave power exciting the plasma source, and the process gas via line 13, are shut off. Likewise, if automatic sequential cleaning is employed, the microwave power and process gas are shut off during the time that photo-cathodes are transferred to and from the receptacles 26 and the holding stand 49, thereby preventing over-exposure damage. The photo-cathodes are then transferred to the degas chamber 28 for low temperature out-gassing to remove any residual impurities, i.e., mainly gas and moisture, from the photo-cathodes. Transfer to the degas chamber 28 may be accomplished either manually or by an automatic mechanism (not shown). In any event, gate valve 29 which separates the two chambers 28 and 24, remains closed during both the plasma conditioning and the degassing operations. The automatic mechanism would open gate valve 29 and pass the plasma processed photo-cathodes therethrough from the receptacles 26 of chamber 24 to receptacles 48 of the degas chamber 28.

The plasma processed photo-cathodes transferred to receptacles 48 in degas chamber 28 are ready for degassing to remove residual gasses and moisture. Any suitable heating element 45 may be employed to provide a non-critical low temperature of less than 500° C. sufficient to eliminate the moisture and gas residues on the photo-cathodes. Since a narrow temperature window need not be attained, sophisticated temperature control and monitoring devices to monitor photo-cathode temperature are not necessary.

One photo-cathode at a time may be mounted for degassing on a heat stand 56 in proximity to the heating element 45. A transfer mechanism (not shown) similar to that used in the plasma conditioning step, may be utilized to transfer the photo-cathodes to and from the heat stand 56 and the receptacles 48. Alternatively, several photo-cathodes may be heated for degassing all at once. In either case, heat is applied to the photo-cathode by the heating element 45 for a predetermined period of time. Gases and moisture evaporated from the photo-cathode during the heating period are removed from the degassing chamber 28 through the exhaust system 30 coupled thereto. Photo-cathodes are then transferred back to the receptacles 48 and degassing is complete. Alternatively, the degas step can be accomplished by applying ultraviolet radiation to the photo-cathodes.

The low temperature cleaning process according to the present invention is complete after the degassing process. The photo-cathodes are then ready to have a negative-electron-affinity layer, such as cesium oxide applied before they are assembled to the remainder of the image intensifier tube. The cesium oxide application process may be readily performed in the same degassing chamber 28 if so desired. In this case, a process cesium holder 44 and an oxygen tank 43 are coupled to chamber 28. The clean photo-cathodes are then suitably mounted for the cesium oxide layer to be properly applied.

From the foregoing, disclosed is an improved low temperature process and apparatus for cleaning Third Generation and similar photo-cathodes used in image intensifier tubes and other light-sensing devices. A key advantage of the present invention over the high temperature processes of the prior art is that the present invention avoids the costly photo-cathode defects often caused by high temperature cleaning such as non-uniform photo-response and crystal slip defects. An additional advantage of the present invention is that a narrow process temperature window is not required, thereby eliminating the need for costly and sophisticated temperature control and monitoring equipment.

It should be understood that the embodiment described herein is merely exemplary and that a person skilled in the art may make many variations and modifications without departing from the spirit and scope of the invention. For example, one skilled in the an may modify the low temperature cleaning apparatus such that both plasma conditioning and degassing operations are performed in one chamber rather than in two separate chambers as described. All such modifications are intended to be included within the scope of the invention as a defined in the appended claims.

What is claimed is:

1. In a low temperature process for cleaning a photo-cathode having a Group III/V semiconductor surface with contaminants thereon, the improvement comprising applying plasma particles to said photo-cathode to remove said contaminants from said photo-cathode.

2. The process according to claim 1 wherein said photo-cathodes are Generation III photo-cathodes.

3. The process according to claim 1 wherein said plasma particles comprise atomic particles.

4. The process according to claim 1 wherein said plasma particles comprise molecular particles.

5. The process according to claim 1 further comprising the step of de-gassing said photo-cathode at a low temperature to remove remaining impurities from said photo-cathode.

6. The process according to claim 5 wherein said de-gassing is performed by applying heat at said low temperature to said photo-cathode.

7. The process according to claim 5 wherein said de-gassing is performed by applying ultra-violet radiation to said photo-cathode at said low temperature.

8. The process according to claim 5 wherein said low temperature is less than 500° C.

9. The process according to claim 1 wherein said photo-cathode has a glass surface on one end and a said Group III/V semiconductor surface on an opposite end.

10. The process according to claim 9 wherein said group III/V semiconductor surface is GaAs.

11. A low temperature process for cleaning photo-cathodes, comprising the steps of:

introducing a photo-cathode having a semiconductor surface with contaminants thereon into a chamber;

coupling a plasma source to said chamber;

evacuating said chamber;

introducing process gas into said chamber;

coupling microwave energy into said chamber in the presence of said process gas such that a plasma is formed, wherein said plasma creates atomic and molecular particles which react with said photo-cathode thereby removing contaminants from the semiconductor surface of said photo-cathode; and de-gassing said photo-cathode at a low temperature to remove remaining impurities from said photo-cathode.

12. The process according to claim 11 wherein said de-gassing is performed by applying heat at said low temperature to said photo-cathode.

13. The process according to claim 11 wherein said de-gassing is performed by applying ultraviolet radiation at said low temperature to said photo-cathode.

14. The process according to claim 11 wherein said process gas comprises a mixture of Argon and Hydrogen.

15. The process according to claim 11 wherein said plasma source is coupled to one end of said chamber, said photo-cathode has a glass surface opposite said semiconductor surface, and said photo-cathode is positioned within said chamber such that said semiconductor surface faces away from said plasma source, whereby damage to said photo-cathode during said cleaning process is minimized.

16. The process according to claim 11 wherein said plasma source is coupled to one end of said chamber, and a baffle is positioned between said source and said photo-cathode, whereby damage to said photo-cathode during said cleaning process is minimized.

17. The process according to claim 11 wherein a pump is coupled to said chamber, said pump being coupled to an exhaust system, and wherein said pump pumps said atomic and molecular particles in a direction from said plasma source past said photo-cathode towards said pump during said removal of contaminants from said photo-cathode.

18. An apparatus for low temperature cleaning of a photo-cathode having a Group III/V semiconductor surface thereon, comprising:

a chamber wherein said photo-cathodes are disposed for cleaning; and means coupled to said chamber for subjecting said photo-cathode to plasma particles to remove contaminants from said Group III/V semiconductor surface of said photo-cathode.

19. The apparatus according to claim 18 further comprising means for de-gassing said photo-cathode at a low temperature to remove remaining impurities from said photo-cathode.

20. The apparatus according to claim 19 wherein said means for de-gassing comprises means for applying heat to said photo-cathode at said low temperature to remove the impurities from said photo-cathode.

21. The apparatus according to claim 19 wherein said means for de-gassing comprises means for applying ultraviolet radiation to said photo-cathode at said low temperature to remove the impurities from said photo-cathode.

22. The apparatus according to claim 19 further including:

means for evacuating said chamber prior to subjecting said photo-cathode to said plasma particles.

23. The apparatus according to claim 22 wherein said means for subjecting said photo-cathode to said plasma particles comprises:

an Electron Cyclotron Resonance plasma source coupled to said chamber;

means for applying process gas to said chamber;

microwave generation means coupled to said chamber;

a pump coupled to said chamber;

whereby said microwave generation means radiates said process gas within said chamber to create said plasma, and said pump operates to enable said plasma particles of said plasma to flow past said photo-cathode to remove contaminants from said photo-cathode.

24. The apparatus according to claim 22 further comprising a second chamber and an exhaust system coupled to said second chamber wherein said means for de-gassing said photo-cathodes are disposed in said second chamber and the remaining impurities are removed from said second chamber via said exhaust system.

25. The apparatus according to claim 24 wherein said second chamber includes a plurality of receptacles for retaining a plurality of photo-cathodes and means for low temperature de-gassing of said plurality of photo-cathodes for removing the remaining impurities from said photo-cathodes in one process step.

26. The apparatus according to claim 22 wherein said chamber further comprises:

a plurality of receptacles for retaining a plurality of photo-cathodes during said cleaning of said photo-cathodes.

27. The apparatus according to claim 26 wherein said chamber further comprises means for mounting one photo-cathode at a time for application of said plasma particles; and means for automatically transferring photo-cathodes to and from said receptacles and said mounting stand whereby a plurality of photo-cathodes may be cleaned in one process step.

28. The apparatus according to claim 27 further comprising:

a second chamber having a plurality of second chamber receptacles wherein each second chamber receptacle retains a photo-cathode;

means for low temperature de-gassing of said photo-cathodes within said second chamber for removing remaining impurities; and second automatic transferring means for transferring photo-cathodes to and from said first chamber receptacles to said second chamber receptacles.

* * * * *